United States Patent [19]

Garries et al.

[11] Patent Number: 4,899,647

[45] Date of Patent: Feb. 13, 1990

[54] VENTILATOR SYSTEM

[75] Inventors: Ray W. Garries, Conneaut; Edward H. Burke, Jefferson, both of Ohio; Joseph D. Leone, Erie, Pa.; Kevin D. Mueller, Conneaut, Ohio

[73] Assignee: Webb Mfg., Inc., Conneaut, Ohio

[21] Appl. No.: 288,462

[22] Filed: Dec. 22, 1988

[51] Int. Cl.[4] ..... F24F 13/18

[52] U.S. Cl. ..... 98/121.1; 52/302; 52/473; 98/29; 98/119

[58] Field of Search ..... 98/29, 116, 119, 121.1; 52/473, 209, 302

[56] References Cited

U.S. PATENT DOCUMENTS

| | | | |
|---|---|---|---|
| 311,784 | 2/1885 | Reillé | 98/121.1 |
| 1,162,241 | 11/1915 | Keyrouse | 98/121.1 X |
| 1,493,655 | 5/1924 | Vernon | 98/119 X |
| 2,509,016 | 5/1950 | Peterson | 98/121.1 |
| 2,663,246 | 12/1953 | Smith | 98/121.1 |
| 2,675,072 | 4/1954 | Smith | 98/121.1 X |
| 2,855,841 | 10/1958 | Smith et al. | 98/121.1 |
| 4,310,993 | 1/1982 | White | 98/121.1 X |
| 4,449,549 | 5/1984 | Week | 98/119 X |
| 4,592,271 | 6/1986 | Young | 98/121.1 X |

FOREIGN PATENT DOCUMENTS

| | | | |
|---|---|---|---|
| 2411705 | 9/1975 | Fed. Rep. of Germany | 98/121.1 |
| 807036 | 12/1936 | France | 98/121.1 |
| 111286 | 7/1944 | Sweden | 98/119 |
| 12742 | of 1904 | United Kingdom | 98/119 |

*Primary Examiner*—Harold Joyce

*Attorney, Agent, or Firm*—Renner, Otto, Boisselle & Sklar

[57] ABSTRACT

Ventilator system includes an external panel and interior baffle defining a plurality of vertically spaced air chambers vertically sealed from one another to prevent water droplets in any one of the air chambers from draining into the lower air chambers. Air passages in the baffle communicate with the respective air chambers at a higher elevation than air passages in the panel. The air stream entering the air chambers through the panel swirls and slows down prior to being discharged through the baffle. Also, side cavities communicate the ends of the air chambers with each other and with a catch basin below the air chambers. Within the air chambers are flap valves which close off the baffle air passages when the force of an air stream entering the air chambers through the panel exceeds a predetermined level to prevent water blow-through under high wind conditions. The baffle substantially fits inside the panel, thus eliminating the need for the builder having to rough out a stud opening in a building structure for receipt of the baffle. The total vent area may be increased for a given ventilator depth by providing some axial overlap between the panel and baffle to permit a corresponding increase in the width of the air passages therein. Also, the front face of the panel brick mold may be tapered axially outwardly for a portion of its width and/or the wall portions of the baffle which contain the baffle air passages may be tapered downwardly and rearwardly to permit the total vent area to be further increased for a given ventilator depth. At the back edge of the brick mold is a nailing flange which may be partially overlapped by a flange on the baffle.

55 Claims, 3 Drawing Sheets

VENTILATOR SYSTEM

BACKGROUND OF THE INVENTION

This invention relates generally, as indicated, to a ventilator system for a building attic or other such dead air space which minimizes water blow-through with minimal sacrifice of vent area.

Normal venting of a roof gable or other dead air space of a building attic is an exhaust flow of air supplied by lower soffet vents. However, water blow-through in a ventilator system caused by a driving rain or snowstorm can be a serious problem especially if the vent area requirements for a particular application are relatively large. In the usual case, the larger the vent area requirements, the greater the amount of water blow-through that is likely to occur.

Heretofore, various efforts have been made to reduce the amount of water blow-through in a ventilator system by increasing the overlap between louver blades, and providing flanges along the length of the blades to disrupt the air flow. However, such prior ventilator designs have not proven to be very effective in preventing water blow-through especially when the rain or snow is driven by high winds. Also, if the louver blades are made of a one-piece plastic molding for reduced maintenance, the louver blades cannot be overlapped because of molding considerations.

Another drawback of known ventilator systems that provide some reduced water blow-through is that they do so at the sacrifice of vent area. Also, such ventilator systems generally require the builder to rough out a stud opening in a building structure for receipt of the ventilator systems, which adds to the cost of installation.

SUMMARY OF THE INVENTION

With the foregoing in mind, it is a principal object of this invention to provide a ventilator system which minimizes water blow-through with minimal reduction in vent area.

Another object is to provide such a ventilator system which requires a minimum amount of maintenance and has a relatively long service life.

Still another object is to provide such a ventilator system which eliminates the need for the builder having to rough out a stud opening for the ventilator system, thus making the ventilator system readily usable for both new and existing structures.

In accordance with one aspect of the present invention, the ventilator system includes an exterior panel having a plurality of air passages therethrough and an interior baffle affixed to the back side of the exterior panel for deflecting any outside air that is blown through the exterior panel upwardly several inches before the air is discharged interiorly of the ventilator system. Such upward movement of the air stream aids in causing any water droplets being carried thereby to drop out of the air stream due to gravity before the air passes into the interior. The exterior panel and interior baffle define therebetween a series of vertically spaced air chambers which are configured to cause any high velocity air stream entering the air chambers through the exterior panel to swirl and slow down to give more time for the water droplets to drop out of the air stream before being discharged into the interior.

Further in accordance with the invention, the air chambers are isolated from each other intermediate their ends so that any water droplets in the respective air chambers will drain back out through the respective openings in the exterior panel rather than into any of the lower air chambers. However, the outermost ends of the air chambers desirably communicate with each other through side cavities located outwardly of the air passages in the exterior panel and interior baffle to help equalize the air pressure in all the air chambers and cause a pressure drop in the air stream entering the side cavities. This drop in pressure also aids in causing any water droplets to fall out of the air stream into a catch basin at the bottom of the ventilator system for draining out through drain holes in the bottom edge of the exterior panel.

Still further in accordance with the invention, the inside surfaces of the air chambers are desirably textured which further assists in causing the water droplets in the air stream to slow down and drop out of the air stream.

In accordance with another aspect of the invention, each baffle air passage is fitted with a flap valve which progressively closes the respective baffle air passage with increased wind speed to prevent water blow-through under high wind conditions. At lower wind speeds, the force of the wind is not sufficient to cause the flap valves to close. However, with increased wind speeds, the flap valves will progressively close until the baffle air passages are substantially completely sealed off to prevent any air (and water droplets) from passing therethrough.

In accordance with still another aspect of the invention, the exterior panel may include a brick mold having the traditional appearance of a conventional louver. At the back edge of the brick mold is a nailing flange that allows the ventilator system to be nailed to exterior sheathing and covered with siding so that the nails do not show and the nailing flange serves as an effective flashing. The interior baffle also desirably fits substantially inside the exterior panel, thus eliminating the need for the builder having to rough out a stud opening in the structure for receipt of the interior baffle.

Further in accordance with the invention, the vent area of the ventilator system may be increased for a given ventilator depth by providing some axial overlap between the exterior panel and interior baffle to permit a corresponding increase in the depth of the air passages in the exterior panel and interior baffle. Also, the total vent area may be further increased for a given ventilator depth by tapering the front face of the brick mold axially outwardly (forwardly) for a portion of its width while still maintaining a traditional brick mold appearance and/or tapering the wall portions of the baffle which contain the baffle air passages downwardly and rearwardly to permit the depth of the air passages to be increased.

In accordance with yet another aspect of the invention, the outer wall portion of the brick mold is desirably stepped at a distance from the brick mold front face substantially corresponding to the depth of a standard brick mold (i.e. approximately 1¼ inches) to enhance the aesthetics of the brick mold by breaking up the normally smooth outer wall portion and giving the illusion that it has a depth approximately the same as a standard brick mold.

Still further in accordance with the invention, the baffle itself may be provided with a flange overlapping a portion of the brick mold flange to ensure against the baffle being blown off the exterior panel even in the highest winds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 1 is a fragmentary perspective view showing a preferred form of ventilator system in accordance with the present invention installed in the gable of a building attic and the like;

FIG. 4 is an enlarged fragmentary vertical section through the ventilator system of FIG. 2 taken generally along the plane of the line 4—4 thereof, and shown installed in a building attic and the like;

DETAILED DESCRIPTION OF THE PREFERRED EMBODIMENT

Figure 1:
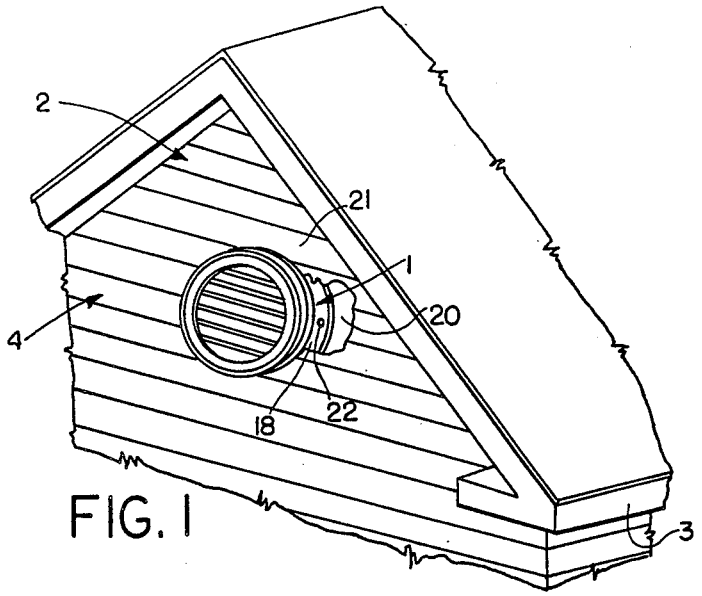
Figure 2:
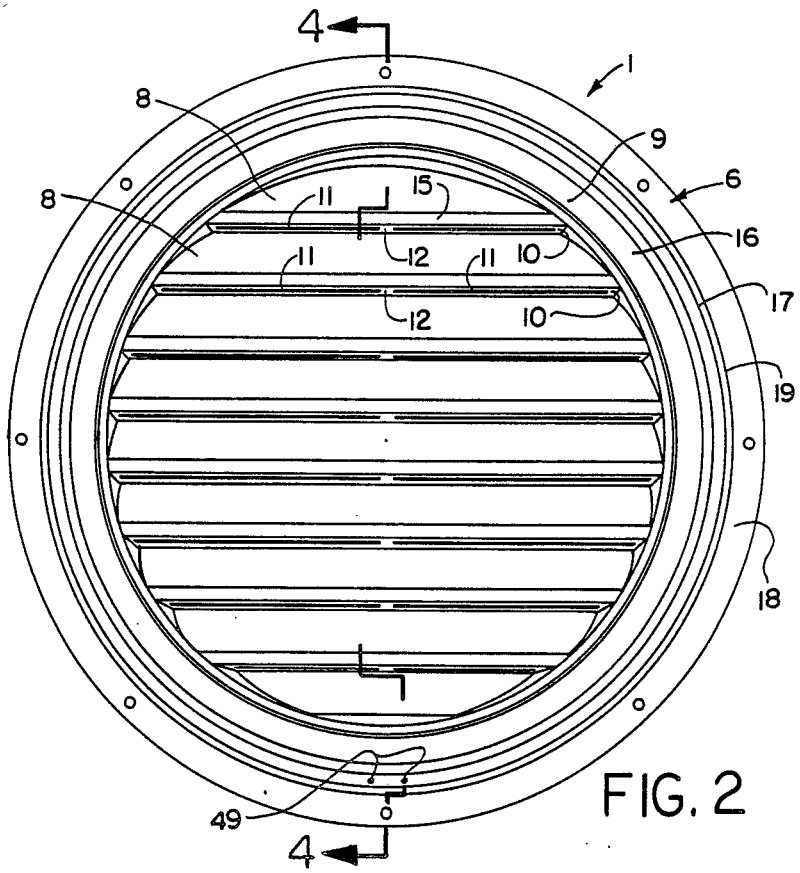
FIG. 2 is an enlarged front elevation view of the ventilator system of FIG. 1.

Referring now in detail to the drawings, and initially to FIGS. 1 and 2, there is shown a preferred form of ventilator system 1 in accordance with this invention. Such ventilator system 1 is primarily intended to be used as an exhaust vent for venting attics 2 or similar dead air spaces of a residential or light commercial building and the like. Normally, air enters the attic 2 through soffit vents (not shown) under the roof eaves 3 and exhausts out through the ventilator system 1. However, the ventilator system 1 also permits air to enter the dead air space through the ventilator system except under extremely high wind conditions as described hereafter.

In the preferred form of the invention illustrated herein, the ventilator system 1 is a louver type ventilator system which may be installed at one or both ends of a roof gable 4. However, the same principles are equally applicable to cupolas and ridge vent type ventilator systems used to vent the ridgeline of a roof. Also, while the ventilator system 1 is shown as being generally round, it may be of other traditional millwork designs and shapes, including, for example, octagon, round-top, and half-round.

Figure 3:
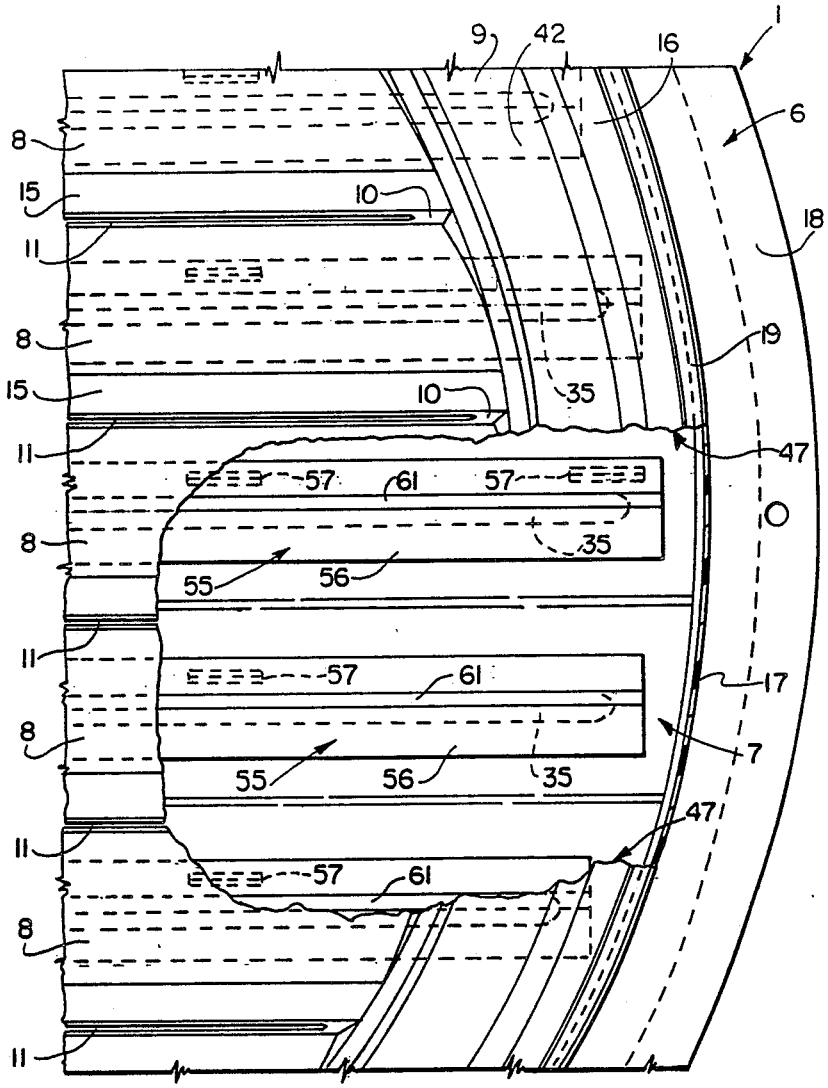
FIG. 3 is a further enlarged front elevation view of a portion of the ventilator system of FIG. 2 with portions of the exterior panel broken away to show the interior baffle behind the exterior panel.
Figure 4:
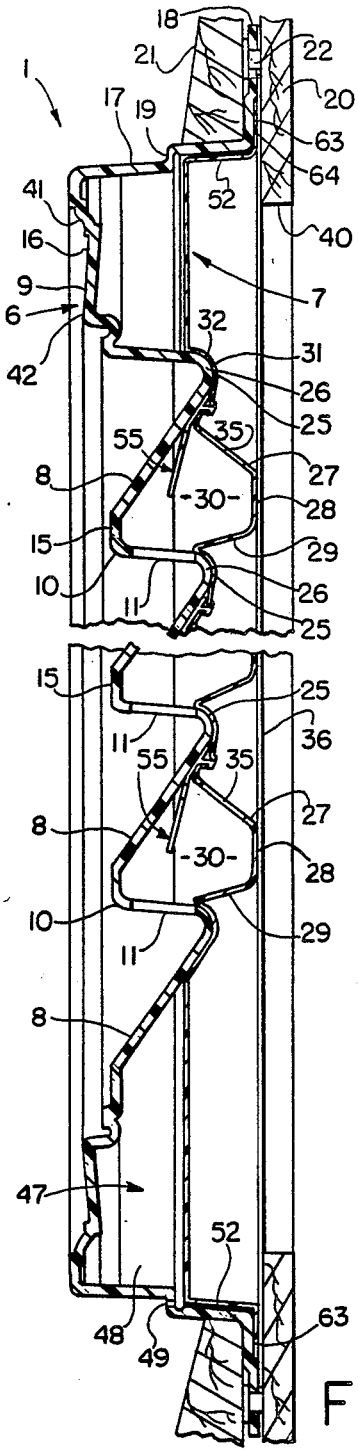

As best seen in FIGS. 3 and 4, the ventilator system 1 includes an exterior panel 6 and interior baffle 7, both of which are desirably one-piece moldings made out of a suitable plastic material such as ABS plastic using conventional vacuum forming techniques and the like. Making these parts out of plastic has the advantage that the ventilator system 1 requires very little maintenance and no painting or other finishing. Also, the interior baffle 7 may be made out of a thinner plastic material than the exterior panel 6 in that the exterior panel may be used to provide the necessary support for a relatively thin interior baffle. Additionally, the plastic used to make the interior baffle may be a less expensive plastic in that it need not have the same high resistance to ultraviolet radiation caused by direct exposure to sunlight as the exterior panel.

When the ventilator system 1 is to be used as a louver, the exterior panel 6 desirably has the traditional appearance of a conventional louver, including a plurality of vertically spaced, downwardly and forwardly sloping louver blades 8 surrounded by a brick mold trim 9 or the like. However, the louver blades 8 cannot be molded so that they overlap each other or otherwise the exterior panel 6 could not be removed from the mold during the molding operation. Instead, the lower edge of each blade 8 is connected to the upper edge of the succeeding blade 8 by a generally rearwardly extending wall portion 10 (which may have a slight downward draft) through which air passages 11 are provided. Preferably, there are at least two such laterally spaced air passages 11 in each rearwardly extending wall portion 10, with a plastic partition 12 therebetween (see FIG. 2) for increased rigidity. Also, the louver blades 8 are desirably provided with a generally flat, downwardly extending wall portion 15 adjacent the bottom edge thereof.

The brick mold 9 includes a generally forwardly facing front face 16 and a rearwardly extending outer wall portion 17. For aesthetic reasons, the outer wall portion 17 of the brick mold 9 desirably has a maximum depth of approximately 2¼ inches. Also, a step 19 is desirably provided in the outer wall portion 17 (see FIG. 4) at a distance from the front face 16 substantially corresponding to the depth of a standard brick mold (i.e. approximately 1¼ inches) to enhance the aesthetics of the brick mold 9 by breaking up the normally smooth outer wall portion 17 and giving the illusion that it has a depth substantially the same as a standard brick mold.

Referring further to FIG. 4, the louver blades 8 preferably have an axial depth less than the depth of the outer wall portion 17 for a purpose to be subsequently described. Extending radially outwardly from the back edge of the outer wall portion 17 is an integral nailing flange 18 which permits the ventilator system 1 to be nailed to the exterior sheathing 20 of a building and subsequently covered with siding 21 so that the nails 22 do not show and the flange 18 serves as an effective flashing as schematically shown in FIGS. 1 and 4.

Figure 5:
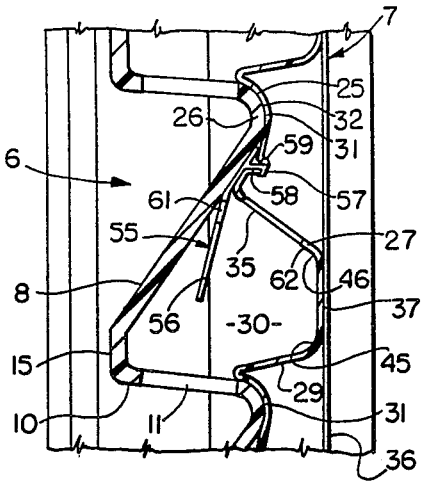
FIG. 5 is a further enlarged fragmentary vertical section through one of the air chambers and flapper valves of the ventilator system of FIG. 4 showing the flapper valve in the open position.
Figure 6:
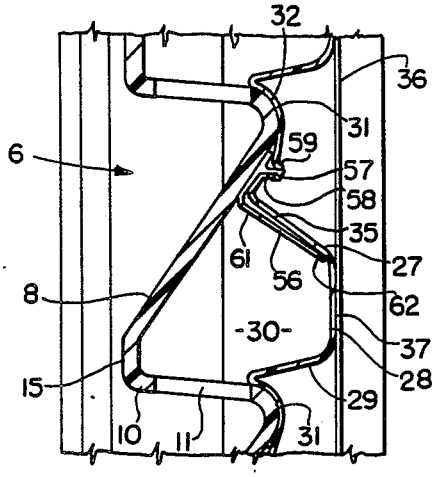
FIG. 6 is an enlarged fragmentary vertical section similar to FIG. 5 but showing the flapper valve in the closed position.

Referring still further to FIG. 4 and also to FIGS. 5 and 6, the interior baffle 7 includes a plurality of transverse, vertically spaced, forwardly facing channels or grooves 25 generally corresponding in shape and spacing to the rounded back sides 26 of the upper ends of the louver blades 8 for engagement therewith to facilitate proper orientation and attachment of the baffle 7 to the back side of the exterior panel 6 as described hereafter. Between successive channels 25 the baffle 7 includes a first wall portion 27 which desirably slopes generally rearwardly and downwardly from the lower edge of the previous channel 25, a second wall portion 28 which extends generally vertically downwardly from the lower edge of the first wall portion 27, and a third wall portion 29 which extends generally forwardly and downwardly from the bottom edge of the second wall portion 28 approximately up to the rearwardmost edge of the respective panel air passages 11 and then wraps back around the innermost end of the panel wall 10 to form a continuation of the next succeeding channel 25, thus defining with the exterior panel 6 a plurality of vertically spaced air chambers 30. The baffle 7 may be maintained in tight sealing engagement with the panel 6 along the length of the baffle channels 25 as by ultrasonically welding the two members together at 31 along such baffle channels 25. This prevents any water droplets in any one of the air chambers 30 from draining down into a lower air chamber. If desired, a suitable sealant material 32 may also be placed between the baffle channels 25 and rounded back sides 26 of the louver blades 8.

Extending through each of the first wall portions 27 of the baffle 7 are one or more air passages 35. Preferably, two or more laterally spaced air passages 35 are provided in each wall portion 27, with a partition therebetween, similar to the partition 12 between the air passages 11 in the exterior panel 6, to give greater rigidity thereto.

The rearwardmost baffle wall portions 28 are desirably substantially flat and in the same vertical plane to facilitate attachment of a screen-like material 36 thereto as by ultrasonically welding the screen material to the wall portions 28 at 37 right after the baffle 7 is ultrasonically welded to the panel 6. The screen material 36, which is desirably made of aluminum, acts as an insect barrier to prevent insects and the like from entering the interior space through the ventilator system 1.

Preferably, the interior baffle 7 substantially fits inside the exterior panel 6 with little or no protrusion of the baffle 7 therebehind as schematically shown in FIGS. 4–6. This eliminates the need for a builder having to rough out a stud opening in the building structure for receipt of the baffle 7 during installation of the ventilator system 1. All the builder need do is cut a hole 40 in the exterior sheathing 20 of a size somewhat less than the inner diameter of the brick mold nailing flange 18 and nail the nailing flange 18 to the sheathing 20 as further shown in FIG. 4. This results in a substantial saving in the installation cost, and also opens up the use of the ventilator system 1 in the retrofit and siding market.

The relatively shallow overall depth of the ventilator system 1, which desirably substantially corresponds to the depth of the brick mold wall portion 17, places some restrictions on the amount of vent area that can be provided by the ventilator system. However, providing some axial overlap between the interior baffle 7 and exterior panel 6 where the baffle 7 wraps around the upper back sides 26 of the louver blades 8 allows for some increase in the width of vent passages 11, 35 in the exterior panel 6 and interior baffle 7 for a given overall axial depth. Also, the total vent area of the ventilator system 1 can be further increased for a given overall axial depth by tapering the brick mold outer face 16 axially outwardly for at least a portion of the depth of the inward (rearward) step 41 adjacent the outer edge of the brick mold 9 while still maintaining a traditional brick mold appearance. In one example of ventilator system 1 in accordance with the present invention, the step 41 adjacent the outer edge of the brick mold 9 extends rearwardly approximately ¼ inch, whereas the outwardly facing wall portion 42 radially inwardly thereof tapers axially outwardly approximately ⅛ inch over a radial distance of approximately one inch to permit a similar increase in the width of the respective air passages 11 and 35 in the external panel 6 and interior baffle 7. Also, the downward slope of the first wall portions 27 of the baffle 7 permits a further increase in the width of the baffle vent passages 35 contained therein for a given baffle depth.

As previously discussed, the ventilator system 1 of the present invention is primarily designed as an exhaust vent to provide for the outflow of air from an attic or other dead air space. Normally air enters the attic through soffit vents under the roof eaves 3 and exhausts out through the ventilator system 1. However, such a ventilator system 1 also permits some air to enter the dead air space through the ventilator system, especially when the dead air space is provided with more than one ventilator system so that the air can enter one ventilator system and exit out through another.

To prevent rain and snow from being blown into the interior space through the ventilator system 1 under normal wind conditions, the air passages 35 in the baffle 7 are vertically spaced a substantial distance above the associated air passages 11 in the exterior panel 6 that communicate with the same air chamber 30, for example, one and one-half to three inches above the respective air passages 11. This requires the air stream entering the respective air chambers 30 through the passages 11 to travel upward a substantial distance to aid in causing the water droplets to fall out of the air stream due to gravity before the air stream is discharged into the interior through the passages 35.

Also, water blow-through in the ventilator system 1 under normal wind conditions may be further reduced by providing an abrupt increase in the area of the air chambers 30 immediately adjacent the air passages 11 and by providing radiused corners 45, 46 on the back wall 28 of the air chambers 30 (see FIG. 5) which cause the air stream entering the air chambers 30 through the air passages 11 to slow down and swirl, thus providing more time for the water droplets to fall out of the air stream before exiting the air chambers 30 through the air passages 35.

Additionally, water blow-through under normal wind conditions may be reduced still further by connecting the ends of all of the air chambers 30 to side cavities 47 between the exterior panel 6 and interior baffle 7 located outwardly of the air passages 11, 35 therein (see FIGS. 3 and 4). Such side cavities 47 help to equalize the air pressure in all of the air chambers 30 and cause a drop in pressure in the air stream entering the side cavities 47 from any of the air chambers 30 which further aids in causing any water droplets in the air stream to fall out of the air stream and into a catch basin 48 between the exterior panel 6 and interior baffle 7 at the bottom of the ventilator system 1 for draining out through weep holes 49 in the bottom edge of the exterior panel 6 (see FIGS. 2 and 4).

Figure 7:
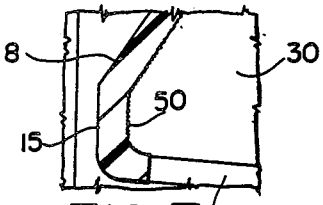
FIG. 7 is an enlarged fragmentary vertical section through a portion of one of the air chambers of the ventilator system showing the texturing of the inner walls thereof.

Moreover, the inner surfaces 50 of the air chambers 30 may be textured as schematically shown in FIG. 7 to further slow the water droplets down to aid in causing the water droplets to drop out of the air stream before the air stream enters the interior through the ventilator system 1. Also, the air passages 35 in the interior baffle 7 may be somewhat larger, for example, approximately 5% larger, than the air passages 11 in the exterior panel 6 to further slow the air down to aid in causing the water droplets to drop out from the air stream before the air stream enters the interior.

The air chambers 30 are separated from each other in a vertical direction by the ultrasonic welds 31 and/or sealant 32 between the baffle channels 25 and rounded back sides 26 of the louver blades 8 as described previously. Accordingly, the water droplets that separate out of the air stream passing through the respective air chambers 30 will flow back out through the respective air passages 11 in the exterior panel 6. Any water droplets that drop out of the air stream passing through the side cavities 47 along the sides of the ventilator system 1 will flow down into the catch basin 48 at the bottom of the ventilator system and be routed to the exterior through the drain holes 49 previously described. Any water that collects in the catch basin 48 is prevented from seeping out between the exterior panel 6 and interior baffle 7 by placing additional sealant 52 therebetween radially outwardly of the catch basin.

To prevent water blow-through under higher than normal wind conditions or when the ventilator system 1 is subjected to high wind gusts, each baffle air passage 35 is desirably fitted with a flapper valve 55 which progressively closes the respective baffle air passages 35 with increased wind speeds. In the preferred form of ventilator system 1 disclosed herein, each flapper valve 55 is made of an extruded rubber-like material having a valve flap 56 at one end and a plurality of laterally spaced hooks 57 adjacent the other end for snapping engagement into correspondingly spaced slots 58 in the baffle 7 above the respective baffle air passages 35 for holding the flapper valves 55 in place with the valve flaps 56 extending generally downwardly into the respective air chambers 30 adjacent the baffle air passages 35 as schematically shown in FIG. 5.

Each flapper valve 55 desirably has an overall length somewhat greater than the combined lengths of the respective air passages 35 communicating with each air chamber 30. The desired number of hooks 57 may be formed as by notching the end of the extrusion opposite the valve flap 56. Also, a corresponding number of slots 58 may be formed in the baffle 7 as by forming spaced apart rearwardly extending creases or folds 59 in the baffle 7 during the molding operation and subsequently cutting off the rearwardmost ends of the creases to form the slots 58. The number and spacing of the hooks 57 and slots 58 may of course be varied depending on the overall length of the flapper valves 55.

Between the valve flap 56 and hook 57 of each flapper valve 55 is a flexible plastic hinge 61 which is sufficiently rigid to maintain the flapper valves 55 in the open position shown in FIGS. 4 and 5 at lower wind speeds, for example, below 30 m.p.h. However, as the speed of the air stream entering the respective air chambers 30 from the exterior increases to a higher level, for example, above 30 m.p.h., the force of the air stream acting on the valve flaps 56 will cause the valve flaps 56 to move upwards about the flexible hinges 61 toward the air passages 35 to progressively close off such air passages. The higher the wind force, the further the valve flaps 56 will be moved toward the baffle air passages 35 until the valve flaps 56 finally engage the rearwardmost edges 62 of the baffle air passages 35 and substantially completely close off such baffle air passages as schematically shown in FIG. 6. The plastic memory of the flexible hinge 61 will cause the valve flaps 56 to spring open only after the wind speed drops back below a predetermined level. However, even under extremely high wind conditions or high wind gusts, the force of the air stream entering each of the air chambers 30 will vary, thus causing the flapper valves 55 to open and close at different times.

From the foregoing, it will now be apparent that the ventilator system of the present invention provides a low maintenance exterior requiring no finishing, and eliminates the water blow-through problems associated with high winds and rain or sleet or snow combined. In actual tests, it has been found that the subject ventilator system gives superior water blow-through performance while allowing the ventilation areas to be as much as 100% higher than competitive ventilator systems of the same unit dimensions. Moreover, the ventilator system of the present invention, being made of a long lasting plastic material, has a service life that greatly exceeds those made of wood products due to the lack of decay or insect infestation while still permitting the ventilator system to be molded in traditional millwork designs and shapes such as round, octagon, round-top and half-round.

Also, as previously indicated, the ventilator system of the present invention eliminates the need for the builder having to rough out a stud opening for the ventilator system, which reduces the installation costs and permits use of the ventilator system in the retrofit and siding market. In addition, the integral nailing flange 18 on the brick mold 16 serves as an effective flashing and allows the ventilator system to be installed without any nails showing. Furthermore, the baffle 7 itself may be provided with a radial outwardly extending flange 63 at the axial inner (rearwardmost) end thereof which radially overlaps the nailing flange 18 so as to be trapped between the nailing flange 18 and sheathing 20 during installation to ensure against the baffle 7 being blown off the exterior panel 6 even in the highest winds. In the preferred form of the invention disclosed herein, the nailing flange 18 is desirably stepped to provide a recess 64 in the back side of the nailing flange 18 for receipt of the baffle flange 63 so that the back side of the baffle flange 63 is substantially flush with the back side of the nailing flange 18 as schematically shown in FIG. 4. Also, the baffle flange 63 is desirably joined to the nailing flange 18 and the screen material 36 is desirably joined to the baffle flange 63 as by ultrasonic welding.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A ventilator system comprising exterior panel means, interior baffle means in sealed engagement with a back side of said exterior panel means at a plurality of vertically spaced locations defining therebetween a plurality of vertically spaced air chambers having upper and lower ends, said panel means having plural vertically spaced first air passage means communicating with the respective air chambers adjacent said lower ends, and said baffle means having plural vertically spaced second air passage means communicating with the respective air chambers adjacent said upper ends, said first and second air passage means for each of said air chambers being vertically spaced from each other, whereby air entering said air chambers through said first air passage means must pass vertically upwardly through said air chambers prior to discharge through said second air passage means, said exterior panel means including a plurality of vertically spaced downwardly and forwardly extending louver blades, and generally rearwardly extending intermediate wall portions between a bottom edge of said blades and a top edge of the next succeeding blade, said first air passage means extending through each of said intermediate wall portions.

2. The ventilator system of claim 1 wherein there is a vertical height of at least approximately one and one-half inches between said first and second air passage means communicating with each of said air chambers.

3. The ventilator system of claim 1 wherein the volumetric area of each of said air chambers abruptly increases adjacent the respective first air passage means.

4. The ventilator system of claim 3 wherein each of said air chambers includes a back wall rearwardly spaced from said first air passage means having radiused corner means to cause air entering said air chambers through said first air passage means to slow down and swirl prior to exiting out through said second air passage means.

5. The ventilator system of claim 1 wherein said exterior panel means is a one-piece plastic molding.

6. The ventilator system of claim 5 wherein said interior baffle means is a one-piece plastic molding.

7. The ventilator system of claim 1 wherein each of said air chambers includes a generally vertical back wall, each of said back walls being in a common vertical plane to provide mounting surfaces for screen material placed against said back walls.

8. The ventilator system of claim 7 wherein said baffle means has a radial flange member in substantial radial alignment with said back walls, said screen material being attached to said radial flange and back walls.

9. The ventilator system of claim 1 further comprising a brick mold surrounding said blades, said brick mold including a generally forwardly facing front face and a generally rearwardly extending outer wall portion.

10. The ventilator system of claim 9 further comprising an integral nailing flange on a back edge of said outer wall portion.

11. The ventilator system of claim 10 wherein said outer wall portion has a maximum depth from said front face to said nailing flange of approximately 2¼ inches.

12. The ventilator system of claim 11 further comprising a step in said outer wall portion located intermediate the length of said outer wall portion.

13. The ventilator system of claim 12 wherein said step is located approximately 1¼ inches from a radial outer edge of said front face.

14. The ventilator system of claim 10 wherein said interior baffle means fits substantially completely inside said outer wall portion.

15. The ventilator system of claim 14 wherein said interior baffle means includes a radially outwardly extending flange at an axial inner end thereof which radially overlaps said nailing flange on said exterior panel means.

16. The ventilator system of claim 15 further comprising seal means between said panel flange and baffle flange.

17. The ventilator system of claim 1 wherein said air chambers have textured interior surfaces.

18. The ventilator system of claim 1 wherein said second air passage means are larger than said first air passage means to aid in slowing down the air entering said air chambers through said first air passage means prior to discharge through said second air passage means.

19. A ventilator system comprising an exterior panel member, an interior baffle member in sealed engagement with a back side of said exterior panel member at a plurality of vertically spaced locations defining therebetween a plurality of vertically spaced air chambers, plural vertically spaced first air passage means in said panel member communicating with the respective air chambers, plural vertically spaced second air passage means in said baffle member communicating with the respective air chambers, a catch basin between said panel member and baffle member below said air chambers, side cavity means between said panel member and baffle member providing communication between said catch basin and the ends of said air chambers, and drain passage means in said panel member for draining said catch basin.

20. The ventilator system of claim 19 wherein said panel member includes a plurality of vertically spaced downwardly and forwardly extending louver blades defining said first air passage means therebetween, and a brick mold surrounding said blades, said brick mold including a generally forwardly facing front face and a rearwardly extending outer wall portion, said side cavity means being located behind said front face.

21. The ventilator system of claim 20 further comprising an integral nailing flange on a back edge of said outer wall portion, said outer wall portion defining the maximum depth of said ventilator system.

22. A ventilator system comprising an exterior panel member, an interior baffle member in sealed engagement with a back side of said exterior panel member at a plurality of vertically spaced locations defining therebetween air chamber means, first air passage means in said panel member communicating with said air chamber means, second air passage means in said baffle member communicating with said air chamber means, and valve means within said air chamber means which is acted upon by an air stream entering said air chamber means through said first air passage means to close off said second air passage means when the force of such air stream acting on said valve means exceeds a predetermined level.

23. The ventilator system of claim 22 wherein said valve means comprises flapper valve means extending downwardly from said baffle member into said air chamber means adjacent said second air passage means, said flapper valve means being progressively movable toward said second air passage means as the force of the air stream acting on said flapper valve increases.

24. The ventilator system of claim 23 wherein said valve means further comprises flexible plastic hinge means providing for such progressive movement of said flapper valve means.

25. The ventilator system of claim 24 wherein said flexible plastic hinge means causes said flapper valve means to spring open when the force of the air stream acting on said valve flap means drops below a predetermined level.

26. A ventilator system comprising an exterior panel member, an interior baffle member in sealed engagement with a back side of said exterior panel member at a plurality of vertically spaced locations defining therebetween air chamber means, first air passage means in said panel member communicating with said air chamber means, second air passage means in said baffle member communicating with said air chamber means, said exterior panel member having an integral nailing flange, and said interior baffle member having an integral flange extending radially outwardly beyond a radial inner edge of said nailing flange, said nailing flange having a recess in a back side thereof for receipt of said integral flange on said interior baffle member.

27. The ventilator system of claim 26 wherein said exterior panel member includes a generally rearwardly extending outer wall portion surrounding said air chamber means, said nailing flange being integral with a back edge of said outer wall portion.

28. The ventilator system of claim 27 further comprising a step in said outer wall portion intermediate the length of said outer wall portion.

29. The ventilator system of claim 28 wherein said exterior panel member includes a generally forwardly facing front face, said step being located approximately 1¼ inches from a radial outer edge of said front face.

30. A ventilator system comprising exterior panel means, interior baffle means in sealed engagement with a back side of said exterior panel means at a plurality of vertically spaced locations defining therebetween a plurality of vertically spaced air chambers having upper and lower ends, said panel means having plural vertically spaced first air passage means communicating with the respective air chambers adjacent said lower ends, and said baffle means having plural vertically spaced second air passage means communicating with the respective air chambers adjacent said upper ends, said first and second air passage means for each of said air chambers being vertically spaced from each other, whereby air entering said air chambers through said first air passage means must pass vertically upwardly through said air chambers prior to discharge through said second air passage means, said exterior panel means including a plurality of vertically spaced downwardly and forwardly extending louver blades defining said first air passage means therebetween, and a brick mold surrounding said blades, said brick mold including a generally forwardly facing front face and a generally rearwardly extending outer wall portion, an integral nailing flange on a back edge of said outer wall portion, said interior baffle means fitting substantially completely inside said outer wall portion, said interior baffle means including a radially outwardly extending flange at an axial inner end thereof which radially overlaps said nailing flange on said exterior panel means, said nailing flange having a recess in a back side thereof in which said flange on said interior baffle means is received.

31. The ventilator system of claim 30 wherein a back side of said flange on said interior baffle means is substantially flush with the back side of said nailing flange.

32. A ventilator system comprising exterior panel means, interior baffle means in sealed engagement with a back side of said exterior panel means at a plurality of vertically spaced locations defining therebetween a plurality of vertically spaced air chambers having upper and lower ends, said panel means having plural vertically spaced first air passage means communicating with the respective air chambers adjacent said lower ends, and said baffle means having plural vertically spaced second air passage means communicating with the respective air chambers adjacent said upper ends, said first and second air passage means for each of said air chambers being vertically spaced from each other, whereby air entering said air chambers through said first air passage means must pass vertically upwardly through said air chambers prior to discharge through said second air passage means, said exterior panel means including a plurality of vertically spaced downwardly and forwardly extending louver blades defining said first air passage means therebetween, and a brick mold surrounding said blades, said brick mold including a generally forwardly facing front face and a generally rearwardly extending outer wall portion, and generally rearwardly extending intermediate wall portions between a bottom edge of each of said blades and a top edge of the next succeeding blade, said first air passage means extending through each of said intermediate wall portions.

33. The ventilator system of claim 32 wherein each of said first air passage means includes a plurality of laterally spaced openings in each of said intermediate wall portions, and partitions between each of said laterally spaced openings.

34. The ventilator system of claim 32 wherein said front face of said brick mold includes a rearward step adjacent said outer wall portion and an outwardly facing wall portion between said step and said blades which tapers axially outwardly for a portion of the depth of said step to increase the overall depth of said intermediate wall portions and thus said first passage means contained therein for a given overall depth of said air chambers.

35. The ventilator system of claim 34 wherein said interior baffle means includes a plurality of vertically spaced, generally rearwardly and downwardly sloping top wall portions containing said second air passage means, said rearwardly and downwardly sloping top wall portions overlapping a portion of the axial length of said blades to increase the overall depth of said rearwardly and downwardly sloping top wall portions and thus said second air passage means for a given overall depth of said air chambers.

36. A ventilator system comprising exterior panel means, interior baffle means in sealed engagement with a back side of said exterior panel means at a plurality of vertically spaced locations defining therebetween a plurality of vertically spaced air chambers having upper and lower ends, said panel means having plural vertically spaced first air passage means communicating with the respective air chambers adjacent said lower ends, and said baffle means having plural vertically spaced second air passage means communicating with the respective air chambers adjacent said upper ends, said first and second air passage means for each of said air chambers being vertically spaced from each other, whereby air entering said air chambers through said first air passage means must pass vertically upwardly through said air chambers prior to discharge through said second air passage means, and side cavity means between said exterior panel means and interior baffle means communicating with a plurality of said air chambers at the ends of said air chambers.

37. The ventilator system of claim 36 further comprising a water catch basin between said exterior panel means and interior baffle means below said air chambers, said side cavity means communicating with said catch basin to permit any water droplets in the air passing from said air chambers into said side cavity means to drop out of the air into said catch basin, and drain holes through said exterior panel means for draining water from said catch basin.

38. A ventilator system comprising exterior panel means, interior baffle means in sealed engagement with a back side of said exterior panel means at a plurality of vertically spaced locations defining therebetween a plurality of vertically spaced air chambers having upper and lower ends, said panel means having plural vertically spaced first air passage means communicating with the respective air chambers adjacent said lower ends, and said baffle means having plural vertically spaced second air passage means communicating with the respective air chambers adjacent said upper ends, said first and second air passage means for each of said air chambers being vertically spaced from each other, whereby air entering said air chambers through said first air passage means must pass vertically upwardly through said air chambers prior to discharge through said second air passage means whenever an air stream entering said air chambers through said first air passage means produces a force acting on said valve means exceeding a predetermined level, said valve means comprising flapper valve means extending downwardly into the path of an air stream passing through said air chambers from said first air passage means to said second air passage means, said flapper valve means being progressively movable toward said second air passage means as the force of the air stream acting on said flapper valve means progressively increases, said flapper valve means including hook means in snapping engagement with slot means in said baffle means.

39. The ventilator system of claim 38 further comprising means for securing said baffle means to said panel means with said flapper valve means extending downwardly from between said baffle means and panel means into said air chambers adjacent said second air passage means.

40. The ventilator system of claim 38 wherein said flapper valve means is made of extruded plastic including a valve flap at one end, said hook means adjacent another end, and flexible hinge means between said valve flap and hook means.

41. The ventilator system of claim 40 wherein said second air passage means has a rearwardmost edge which is engageable by said valve flaps to seal off said second air passage means.

42. A ventilator system comprising an exterior panel member, an interior baffle member in sealed engagement with a back side of said exterior panel member at a plurality of vertically spaced locations defining therebetween air chamber means, first air passage means in said panel member communicating with said air chamber means, second air passage means in said baffle member communicating with said air chamber means, and valve means within said air chamber means which is acted upon by an air stream entering said air chamber means through said first air passage means to close off said second air passage means when the force of such air stream acting on said valve means exceeds a predetermined level, said valve means comprising flapper valve means extending downwardly from said baffle member into said air chamber means adjacent said second air passage means, said flapper valve means being progressively movable toward said second air passage means as the force of the air stream acting on said flapper valve increases, said valve means including hook means in snapping engagement with slot means in said baffle member.

43. The ventilator system of claim 42 further comprising means for securing said baffle member to said panel member with said flapper valve means extending downwardly into said air chamber adjacent said second air passage means.

44. The ventilator system of claim 42 wherein said flapper valve means is made of extruded plastic including a valve flap means at one end, said hook means adjacent another end, and flexible hinge means between said valve flap means and hook means.

45. The ventilator system of claim 44 wherein said second air passage means has a rearwardmost edge which is engageable by said valve flap means to seal off said second air passage means.

46. A ventilator system comprising exterior panel means, interior baffle means in sealed engagement with a back side of said exterior panel means at a plurality of vertically spaced locations defining therebetween a plurality of vertically spaced air chambers having upper and lower ends, said panel means having plural vertically spaced first air passage means communicating with the respective air chambers adjacent said lower ends, and said baffle means having plural vertically spaced second air passage means communicating with the respective air chambers adjacent said upper ends, said first and second air passage means for each of said air chambers being vertically spaced from each other, whereby air entering said air chambers through said first air passage means must pass vertically upwardly through said air chambers prior to discharge through said second air passage means, said interior baffle means including a plurality of vertically spaced generally rearwardly and downwardly sloping wall portions defining top walls of said air chambers containing said second air passage means, and said exterior panel means including a plurality of vertically spaced generally rearwardly extending wall portions defining bottom walls of said air chambers containing said first air passage means.

47. The ventilator system of claim 46 wherein said exterior panel means also includes a plurality of vertically spaced generally forwardly and downwardly extending louver blades defining front walls of said air chambers, said top walls axially overlapping a portion of said front walls to increase the overall depth of said top walls and thus said second air passage means for a given depth of said air chambers.

48. The ventilator system of claim 46 wherein said interior baffle means also includes a plurality of generally vertically extending wall portions defining back walls of said air chambers, said back walls interconnecting said top and bottom walls and being rearwardly spaced from said first air passage means to provide an abrupt increase in the volumetric area of said air chambers adjacent said first air passage means.

49. A ventilator system comprising exterior panel means, interior baffle means in sealed engagement with a back side of said exterior panel means at a plurality of vertically spaced locations defining therebetween a plurality of vertically spaced air chambers having upper and lower ends, said panel means having plural vertically spaced first air passage means communicating with the respective air chambers adjacent said lower ends, and said baffle means having plural vertically spaced second air passage means communicating with the respective air chambers adjacent said upper ends, said first and second air passage means for each of said air chambers being vertically spaced from each other, whereby air entering said air chambers through said first air passage means must pass vertically upwardly through said air chambers prior to discharge through said second air passage means, and valve means within said air chambers for closing off said second air passage means whenever an air stream entering said air chambers through said first air passage means produces a force acting on said valve means exceeding a predetermined level.

50. The ventilator system of claim 49 wherein said valve means comprises flapper valve means extending downwardly into the path of an air stream passing through said air chambers from said first air passage means to said second air passage means, said flapper valve means being progressively movable toward said second air passage means as the force of the air stream acting on said flapper valve means progressively increases.

51. The ventilator system of claim 50 wherein said valve means further comprises flexible plastic hinge means providing for such progressive movement of said flapper valve means.

52. The ventilator system of claim 51 wherein said flexible plastic hinge means causes said flapper valve means to spring open when the force of the air stream acting on said flapper valve means drops below a predetermined level.

53. A ventilator system comprising exterior panel means, interior baffle means in sealed engagement with a back side of said exterior panel means at a plurality of vertically spaced locations defining therebetween a plurality of vertically spaced air chambers having upper and lower ends, said panel means having plural vertically spaced first air passage means communicating with the respective air chambers adjacent said lower ends, and said baffle means having plural vertically spaced second air passage means communicating with the respective air chambers adjacent said upper ends, said first and second air passage means for each of said air chambers being vertically spaced from each other, whereby air entering said air chambers through said first air passage means must pass vertically upwardly through said air chambers prior to discharge through said second air passage means, said exterior panel means including a plurality of vertically spaced downwardly and forwardly extending louver blades defining front walls of said air chambers, each of said blades having upper ends with rounded back sides, and said interior baffle means having a plurality of vertically spaced, forwardly facing channels engaging said rounded back sides of said blades to facilitate proper orientation and attachment of said interior baffle means to said exterior panel means.

54. The ventilator system of claim 53 wherein said interior baffle means includes a plurality of vertically spaced wall portions sloping generally rearwardly and downwardly from lower edges of said channels, said rearwardly and downwardly sloping wall portions defining top walls of said air chambers which contain said second air passage means.

55. The ventilator system of claim 54 wherein said rearwardly and downwardly sloping wall portions overlap a portion of the axial length of said blades to increase the overall depth of said rearwardly and downwardly sloping wall portions and thus said second air passage means for a given overall depth of said air chambers.

* * * * *